US005566599A

United States Patent [19]

Ebihara

[11] Patent Number: 5,566,599

[45] Date of Patent: Oct. 22, 1996

[54] CUTTER APPARATUS

[75] Inventor: Katsuji Ebihara, Tokyo, Japan

[73] Assignee: Ebihara & Company, Tokyo, Japan

[21] Appl. No.: 253,031

[22] Filed: Jun. 2, 1994

[30] Foreign Application Priority Data

Jun. 2, 1993 [JP] Japan ..... 5-132108
Jun. 3, 1993 [JP] Japan ..... 5-133330

[51] Int. Cl.[6] ..... B26D 7/28

[52] U.S. Cl. ..... 83/76.1; 83/425.3; 83/158; 83/923

[58] Field of Search ..... 83/425.3, 426, 83/430, 435, 438, 440, 440.1, 444, 158, 422, 923, 939, 365, 425, 425.2, 425.4, 435.2, 437, 155, 155.1, 448, 449, 369, 154, 76.1, 106, 424

[56] References Cited

U.S. PATENT DOCUMENTS 1,791,307 2/1931 Goodwin ..... 83/425.3 X
3,709,076 1/1973 Kissell et al. ..... 83/438
4,216,688 8/1980 Cash ..... 83/369
4,737,068 4/1988 Mochizuki ..... 83/155
5,044,240 9/1991 Fischer et al. ..... 83/435.2
5,255,584 10/1993 Fakler ..... 83/155.1
5,438,759 8/1995 Dieringer ..... 30/253

*Primary Examiner*—Rinaldi I. Rada
*Assistant Examiner*—Elizabeth Stanley
*Attorney, Agent, or Firm*—Lowe, Price, LeBlanc & Becker

[57] ABSTRACT

A cutter apparatus having: (a) rotary cutters locked on a common horizontal shaft at intervals, (b) a motor for the cutters, (c) a cloth feeder, (d) a cloth piece separator, (e) a first conveyor to transport the cut cloth pieces to discharge them from the cutter apparatus, (f) a cloth length measurer, (g) a sorter to sort out those cut pieces whose measured lengths are greater than a predetermined value, (h) a second conveyor to transport the cut cloth pieces sorted out by the sorter back to the feed side of the cutter apparatus, (i) a controller to supply a drive signal to the sorter when a measured length of the cloth is greater than the predetermined value to thereby cause the sorter to sort out cut pieces of such cloth and also to supply a stop signal to the sorter when a predetermined time has lapsed from the start of sorting to thereby cause the sorter to stop sorting, and (j) a button remover machine located at the feed side.

7 Claims, 17 Drawing Sheets

A
B
C
1
2
3
4
5
7
9
10
11
12
15
19
20
21
22
23
34
45
46
56
57
58
59
60
61
62
63
64
65
66
67
68
74
84
86
87
88
89
90
91
92
93
94
96
97
98
99
100
101
102

START
STEP1
RESET TIMERS ①,②
STEP2
OPERATION SWITCH ON?
YES (MANUAL MODE)
NO (AUTOMATIC MODE)
STEP10
TIMER ② SOLENOID, MOTOR ALL ON
YES
LIGHT SENSED ?
STEP3
NO
TIMER ① ON
STEP4
STEP11
t > t3 ?
NO
YES
NO
t > t1 ?
STEP5
YES
TIMER ② SOLENOID, MOTOR ALL ON
STEP6
NO
t > t2 ?
STEP7
YES
TIMER ② SOLENOID, MOTOR ALL OFF
STEP8
STEP9
RETURN

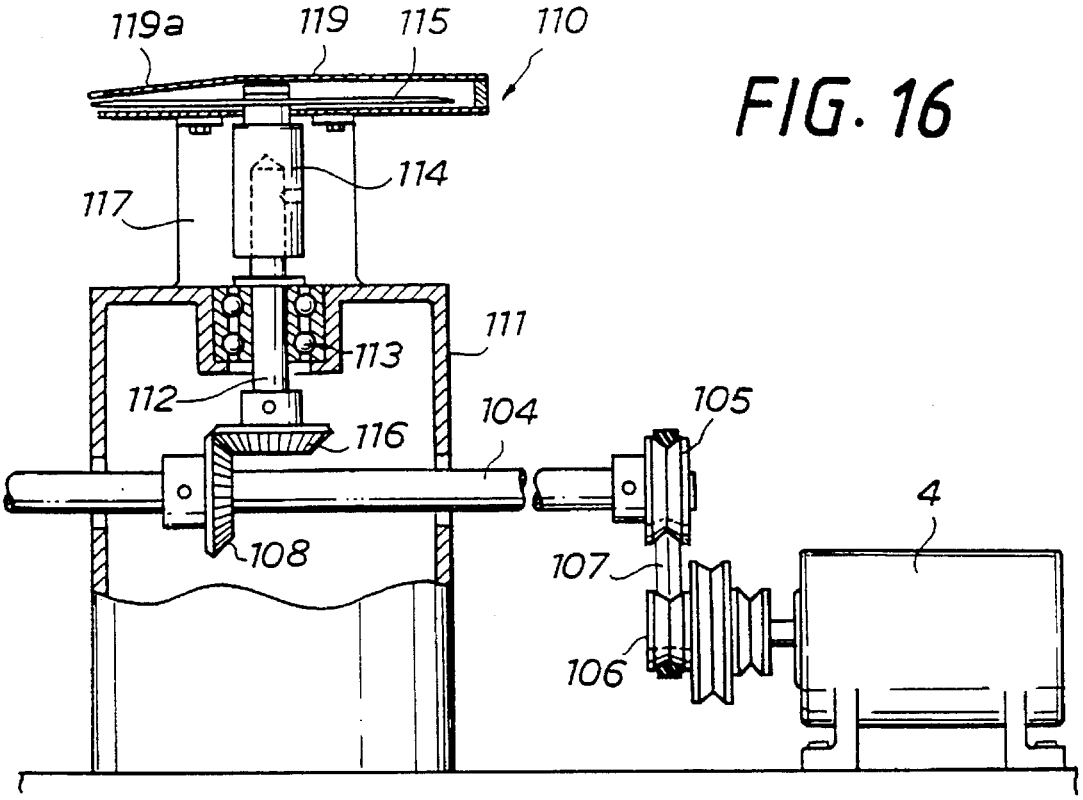
FIG. 16
FIG. 17
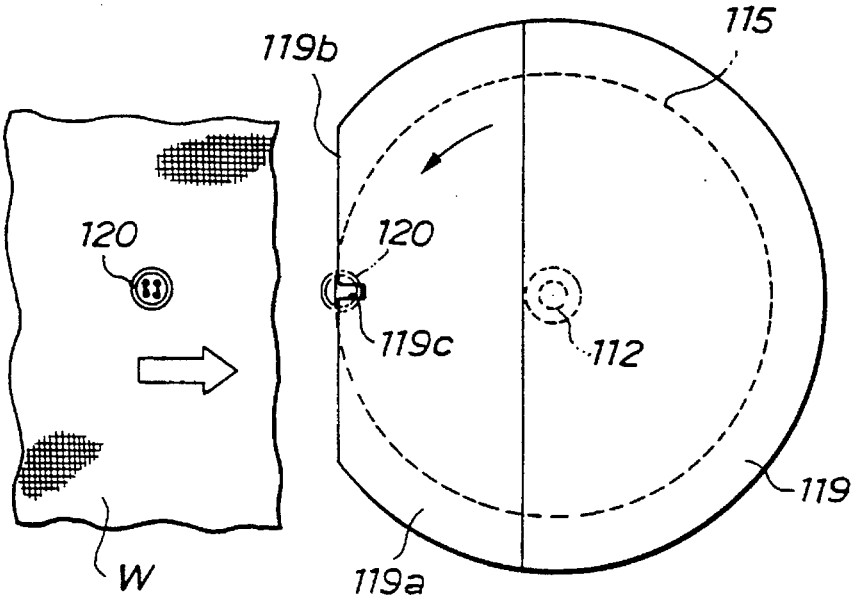

CUTTER APPARATUS

FIELD OF THE INVENTION

The present invention relates to a cutter apparatus for manufacturing "waste" by cutting cloth such as used clothes (old dresses), fabric products, and curtains. The term "waste" as used herein means cloth pieces useful to wipe machinery and absorb oil.

BACKGROUND OF THE RELATED ART

In general, the waste is used to clean machines and other facilities installed in factories, and it is obtained by cutting used cloth into pieces of appropriate sizes.

In the past, machines such as the cutter apparatus 201 shown in FIG. 18 were employed to cut the used cloth to produce handy waste. FIG. 18 is a side view of the conventional cutter apparatus 201, and in this figure the reference numeral 202 designates a drive motor mounted on the base 203, and a pulley 204 is locked at the end of the horizontal output shaft of the drive motor 202. Also, a vertical pulley 206 and a vertical disk-shaped cutter 207 are locked on a common horizontal shaft, which is supported by the edge of the stay 205, extending horizontally from the base 203, in a manner such that the common shaft is freely rotatable. A belt 208 is tightly passed and wound round the pulleys 204 and 206.

When the drive motor 202 is driven to rotate the pulley 204 in the direction indicated by the arrow (clockwise, as viewed in FIG. 18), the rotational torque is transmitted from the pulley 204 to the pulley 206 via the belt 208 and the cutter 207 is caused to turn in the direction indicated by the arrow (clockwise, ditto).

When cloth, not shown, is pushed along the guide 209 into the guide slit 210, the cloth is cut by the turning cutter 207 and desired waste is obtained.

PROBLEMS THE INVENTION SEEKS TO SOLVE

However, when, for example, an old dress was cut into waste pieces by such conventional cutter apparatus 201, the same dress had to be passed through the slit 210 for a number of times (usually three times) before the waste pieces of optimum sizes were obtained.

Furthermore, when the cloth to be cut was wide and lengthy, such as a curtain, the cloth had to be cut more than once from different direction to obtain waste pieces of appropriate sizes, and, therefore, a worker must always stand by the cutter apparatus to sort out the cloth pieces that required to be cut smaller, from the ones of optimum sizes, and this has also caused the cutting operation to be labor and time consuming.

Furthermore, some dresses come with shoulder pads or lining cloth or buttons or studs or the like, so that when such dresses were cut, such attachments had to be removed from the cut dresses before they were used as waste. It was thus necessary for the worker to sort out the cut pieces with shoulder pads or lining cloth or buttons or studs or the like from ones without them.

Conventionally, buttons were removed from the dresses by breaking the button threads with an edged tool such as a knife, a razor, scissors, etc. before the dresses were fed to the cutters. However, it was very troublesome to remove buttons one by one from a dress with an edged tool in one hand and the dress in the other.

SUMMARY OF THE INVENTION

It is, therefore, a principal object of the invention to provide a cutter apparatus with which it is possible to cut relatively small cloth such as dresses into pieces of optimum sizes at once, and when there occur cut pieces that have inappropriately large sizes, it is possible to automatically sort out such large pieces, and when cut pieces that have shoulder pad or lining cloth or buttons or studs or the like attached to them, it is also possible to arbitrarily sort out such pieces. In short, it is desired that an improvement is made in the cutter apparatus such that the cut pieces that require further treatment are automatically as well as arbitrarily sorted out from the ones ready for use and returned to the feed side. Furthermore, it is desired that such an improved cutter apparatus includes a mechanism with which it is possible to remove the buttons and studs effectively.

In a preferred embodiment there is provided a highly efficient cutter apparatus which can cut cloth into waste of optimum sizes at a time or without the need for a operator to sort out the cloth pieces by hand. This new cutter apparatus includes: (a) a plurality of disk-shaped cutters locked on a common horizontal shaft at appropriate intervals, (b) a drive motor to turn the cutters, (c) a means to feed the cloth to the cutters by holding and advancing it, (d) a means to separate the cut cloth pieces apart, (e) a first transport means to transport the separated cloth pieces to discharge them from the cutter apparatus, (f) a means to measure a length of the cloth being supplied to the cutters, the measured length being in the direction in which the cloth is cut, (g) a means to sort out those cut pieces whose measured lengths are greater than a predetermined value from said first transportation means, (h) a second transportation means to transport the cut pieces sorted out by said sort means back to the feed side of the cutter apparatus, and (i) a control means to supply a drive signal to said sort means when a measured length of cloth is greater than said predetermined value to thereby cause the sort means to sort out cut pieces of such cloth and also to supply a stop signal to said sort means when a predetermined time has lapsed from the start of sorting to thereby cause the sort means to stop sorting.

In another embodiment, the cloth feed means comprises several parallel pairs of an upper timing belt assembly and a lower timing belt assembly, the upper timing belt assembly being disposed over the lower timing belt assembly and the distance between the two timing belt assemblies being adjustable.

Furthermore, said upper and lower timing belt assemblies each have two endless track timing belts which run in parallel to each other with a space formed between them for a cutter to be disposed in, a plurality of timing pulleys over which said timing belts are passed, and a drive means to drive one or more of said timing pulleys.

Still more preferably, said measurement means comprises a first optical means to emit a light, a second optical means capable of detecting the emitted light, and a timer adapted to start and stop counting in response to whether or not said light is detected by said second optical means, and said measurement means measure the time in terms of the number counted by said timer.

In yet another preferred embodiment, said sort means comprises a swing arm which is capable of assuming a sorting position over the first transport means and is equipped with an endless track timing belt which runs in a manner such that the cloth that touches it is carried toward the free end of the swing arm, and an actuator adapted to drive the swing arm.

In still another preferred embodiment, said sort means is also capable of being manually started whereby the swing arm assumes the sorting position and stops assuming the sorting position when a predetermined time has lapsed from the start of sorting.

It is also preferred that said cutter apparatus further comprises a button remover means provided near the cloth feed means which remover includes a horizontal rotary cutter enclosed in a disk-like hollow cover body in a manner such that only a limited portion of the cutter edge is exposed from the cover body and at that exposed position the distance between the cutter edge and the roof of the cover body is sufficiently small and the distance between the cutter edge and the floor of the cover body is sufficiently large to allow a button to enter the cover body underneath the cutter edge horizontally and at the location just above the exposed position of the cutter edge the roof of the cover body has a guide recess to guide the button into the cover body.

According to this new cutter apparatus, the cloth that is fed to the cutters by the cloth feed means is cut by a plural number of cutters at a time so that even the cloth of relatively large widths is cut into pieces of optimum sizes by a single feed; at the same time, the cloth pieces are sorted according to their feed lengths.

Also, the cloth is fed to the cutters automatically by the cloth feed means, and the cloth after being cut by the cutters is automatically separated into pieces by the cloth separation means, and furthermore, the cloth pieces are automatically transported away from the cutting apparatus by the first transportation means.

Then, the cut pieces that have excessive length for waste are so detected by the measurement means and automatically sorted out by the sort means and returned to the feed side by the second transportation means and fed to the cutters again until they have optimum sizes. Thus, the operation is further rationalized and the number of workers attending the cutting apparatus can be reduced. Furthermore, time required for the operation is significantly reduced.

Also, according to a preferred embodiment of the invention, when a batch of cloth pieces being cut are such that they are short enough to pass without being sorted out but have some attachments to them such as buttons, then the operator manually causes the sort means to operate for a predetermined time length so as to sort out the cut cloth pieces with the attachments, so that it is no longer necessary for an operator to manually sort out such cloth pieces at the discharge side of the cutter apparatus.

Furthermore, according to the best mode embodiment, a button remover means is provided at the feed side so that it is no longer necessary to remove buttons one by one from the cloth with an edged tool in one hand and the dress in the other.

Thus the present invention attains all of the above-mentioned objects.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more precisely understood from the detailed description given hereinbelow and the accompanying drawings which are given by way of illustration only, and thus are not limitative of the present invention.

BRIEF DESCRIPTION OF THE DRAWINGS

FIG. 16 is a side view of a button remover machine with parts partially broken away.

FIG. 17 is a top plan view of the same button remover machine of FIG. 16.

DETAILED DESCRIPTION OF THE PREFERRED EMBODIMENTS

A preferred embodiment of the invention will now be described with reference to the attached drawings.

Figure 1:
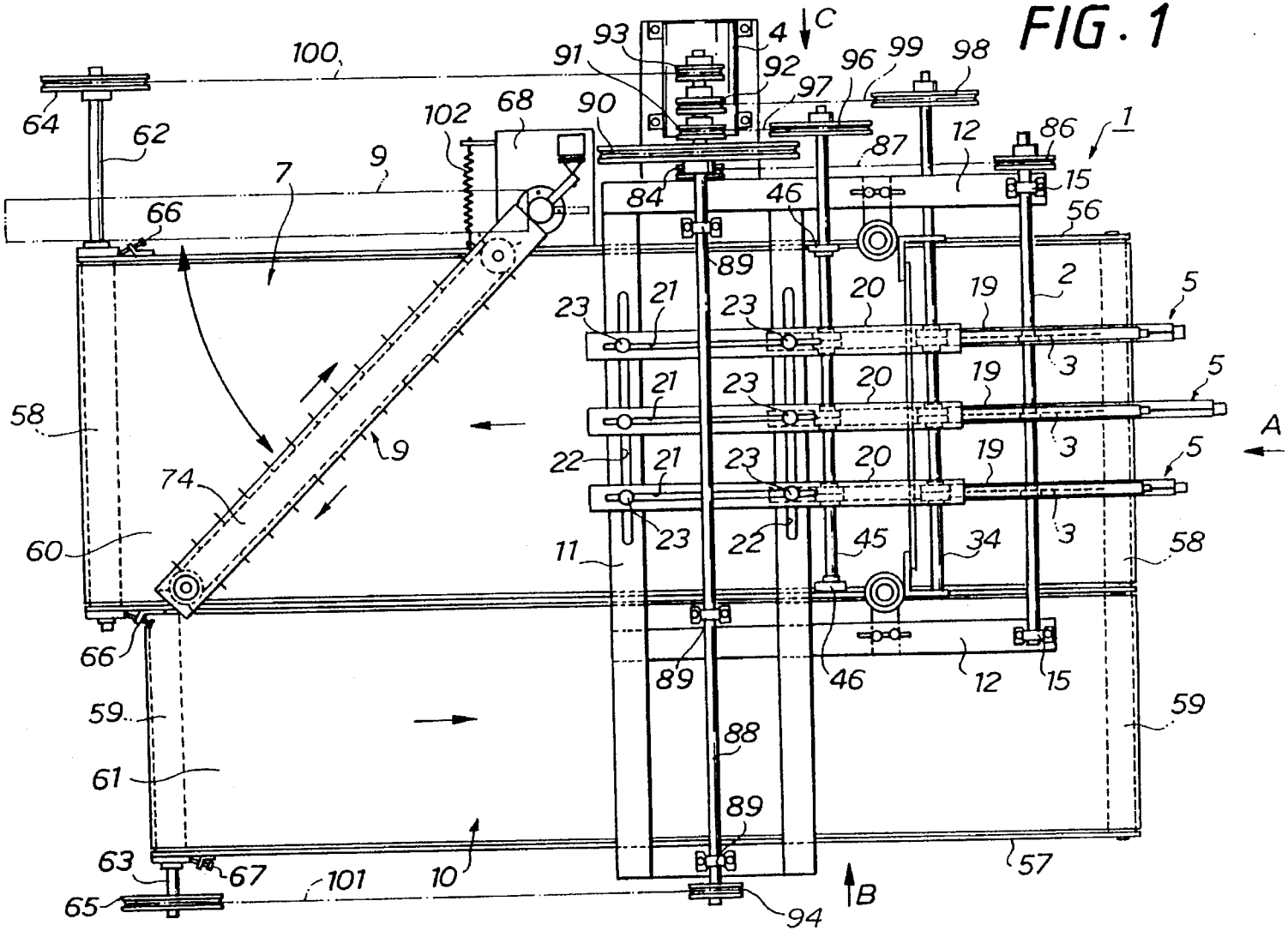
FIG. 1 is a top plan view of a cutter apparatus according to the present invention.
Figure 2:
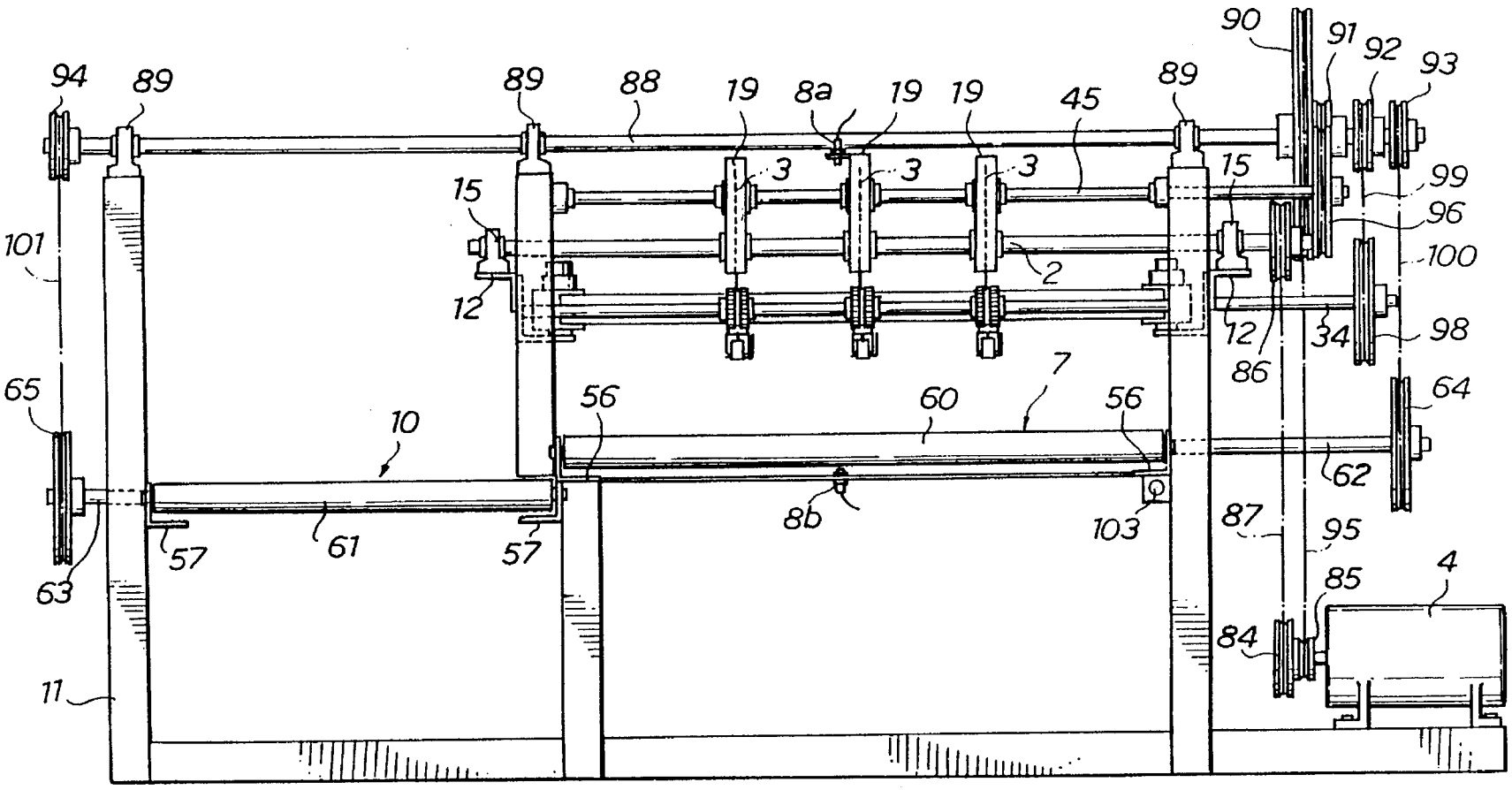
FIG. 2 is a front view of the same cutter apparatus, as viewed in the direction indicated by the arrow A of FIG. 1.
Figure 5:
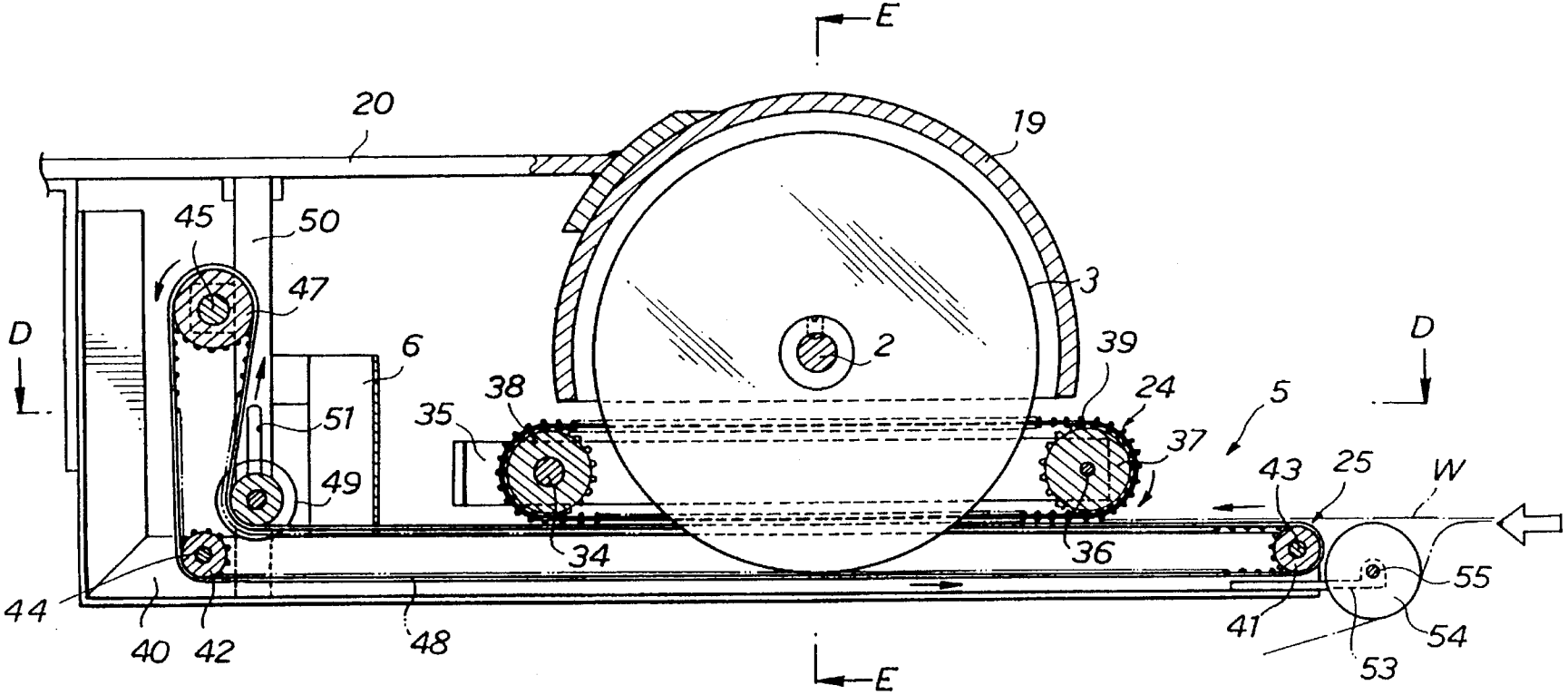
FIG. 5 is a sectional side view of the important elements (cutter, cloth feed means, cloth separation means, etc.) of the same cutter apparatus with parts partially broken away.
Figure 6:
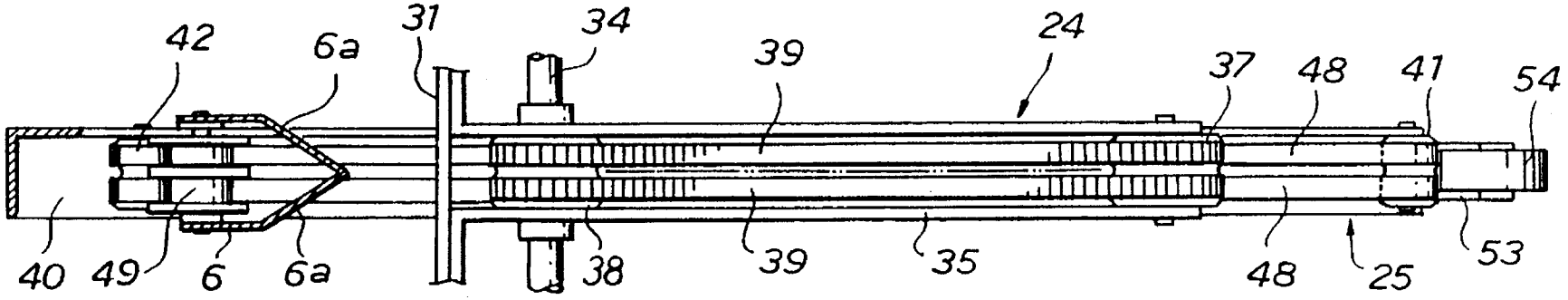
FIG. 6 is a sectional view taken along the lines D—D of FIG. 5.

As shown in FIGS. 1 through 4, the cutter apparatus 1 of the preferred embodiment is constructed basically by comprising three disk-shaped cutters 3 locked on a common rotary shaft 2 at appropriate intervals, a drive motor 4 to turn the cutters 3, a cloth feeder 5 to feed the cloth to the cutters 3, cloth separator 6 to separate the cut cloth pieces apart (ref. FIG. 5 and FIG. 6), a belt conveyor 7 as the first transportation means to transport the separated cloth pieces toward the discharge side of the cutter apparatus, optical sensors 8*a*, 8*b* which constitute the measurement means to measure the length of the cloth being supplied to the cutters 3 by the cloth feeder 5 (ref. FIG. 2), a sorter 9 to sort out cut pieces whose measured lengths are greater than a predetermined value from the belt conveyor 7, another belt conveyor 10 as the second cloth transportation means to transport the cut pieces sorted out by the sorter 9 back to the feed side of the cutter apparatus, and a control means, not shown, to supply a drive signal to the sorter 9 when the measured length of cloth is greater than the predetermined value, to thereby cause the sorter 9 to sort out the cut pieces of such cloth.

Incidentally, the optical sensors 8*a*, 8*b* (measurement means), the sorter 9, the belt conveyor 10, and the control means constitute an automatic assortment assembly. Also, in the present embodiment, the measurement means includes a first timer 2 or which counts the time length during which the optical sensors 8*a*, 8*b* are not optically connected. Furthermore, the cutter apparatus 1 of the present embodiment is equipped with another timer 202 which starts counting time when the time length counted by the timer 200 exceeds a predetermined value.

Now, as shown in FIGS. 1 through 4, a pair of horizontal, parallel, even frames 12 are provided to the base, which is a box-like framework made up of steel bars, in a manner such that the same altitudinal position of the frames 12 is adjustable. As can be partly seen in FIG. 3 and FIG. 4, vertically elongated slits 13 are each formed in the four vertical steel bars of the base 11, and each frame 12 is fastened onto the base 11 at a predetermined altitude by means of bolts 14, which penetrate the frame 12 and the slits 13. The altitudinal position of the frames 12 can be arbitrarily adjusted after loosening the bolts 14.

Bearing sets 15 are provided at the free ends of the frames 12, and the rotary shaft 2 is journaled by these bearing sets 15 so that it is freely rotatable.

Figure 7:
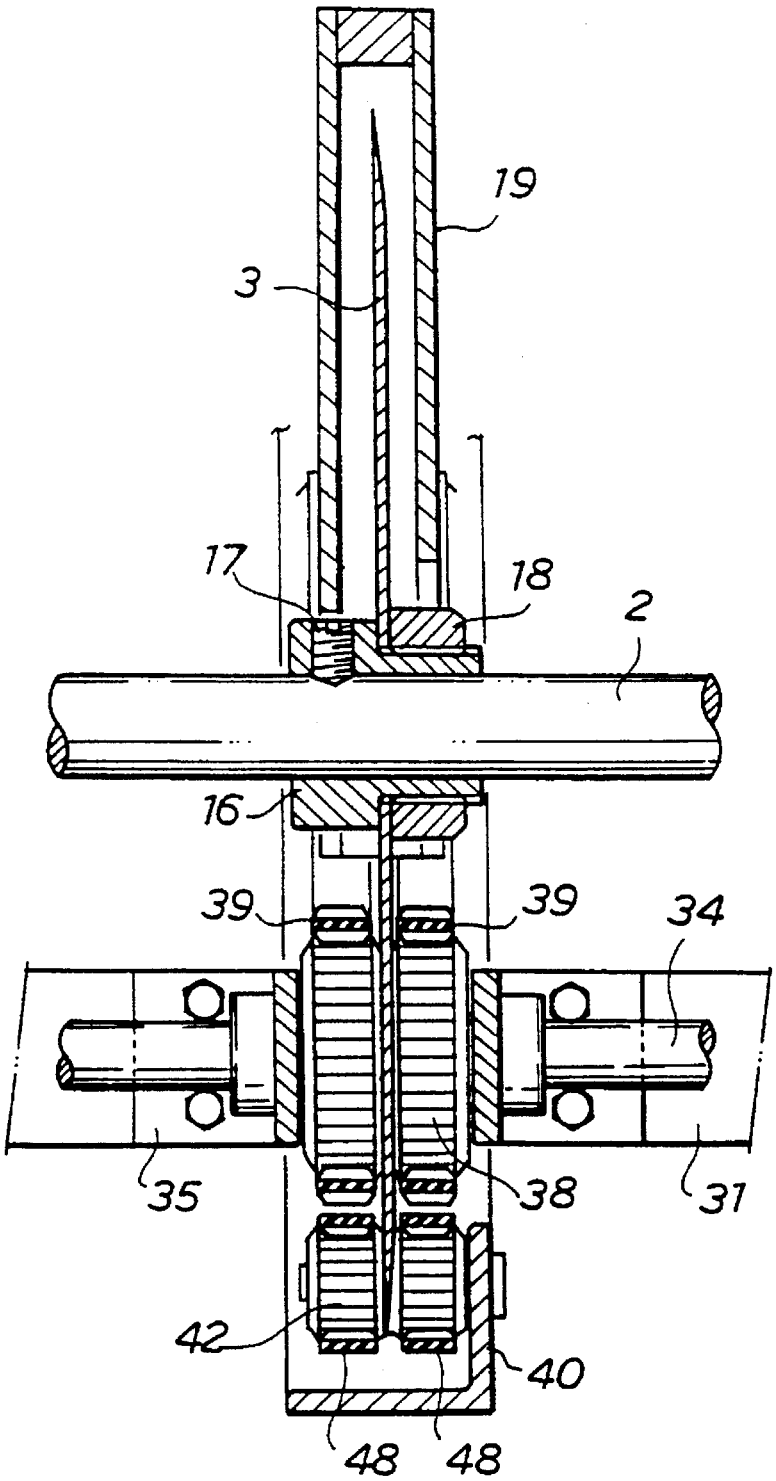
FIG. 7 is a sectional view taken along the lines E—E of FIG. 5.

Now, the details of how the cutters 3 are locked on the rotary shaft 2 will be explained with reference to FIG. 7. A boss member 16 is passed on the rotary shaft 2 such that the boss member 16 is free to shift along the rotary shaft 2. The boss member 16 is then locked on the rotary shaft 2 at a desired location by screwing a vise 17 through the boss member 16 firmly.

A cutter 3 is fitted on the boss member 16, and as a nut member 18 which engages threadably with the boss member 16 is screwed on the boss member 16, the cutter 3 is firmly held between the boss member 16 and the nut member 18 so as to assume a desired location on the rotary shaft 2. The interval as well as the positions of the three cutters 3 can be adjusted at will after loosening the vise 17 and shifting the boss member 16 along the rotary shaft 2.

Figure 3:
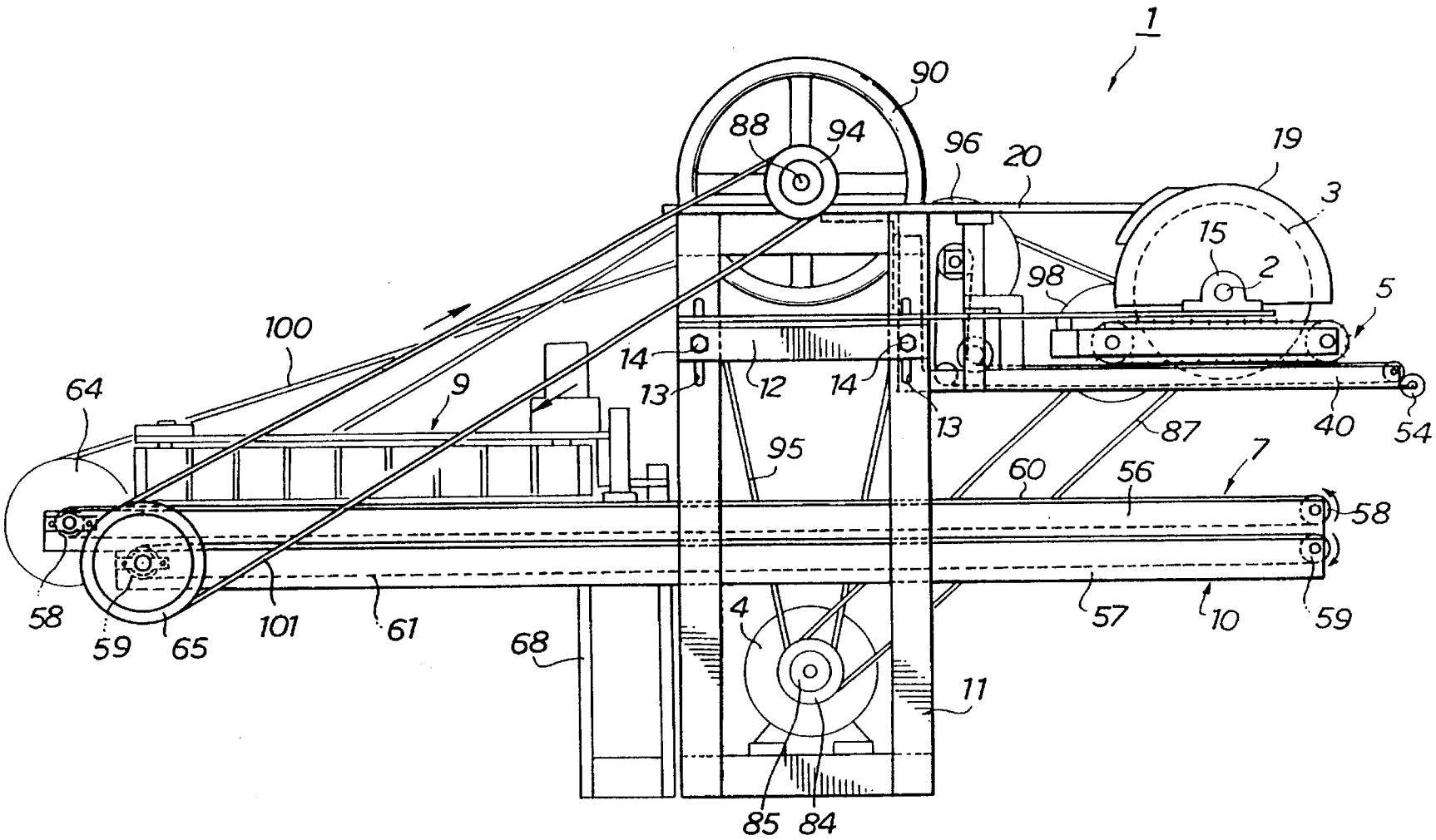
FIG. 3 is a side view of the same cutter apparatus, as viewed in the direction indicated by the arrow B of FIG. 1.
Figure 4:
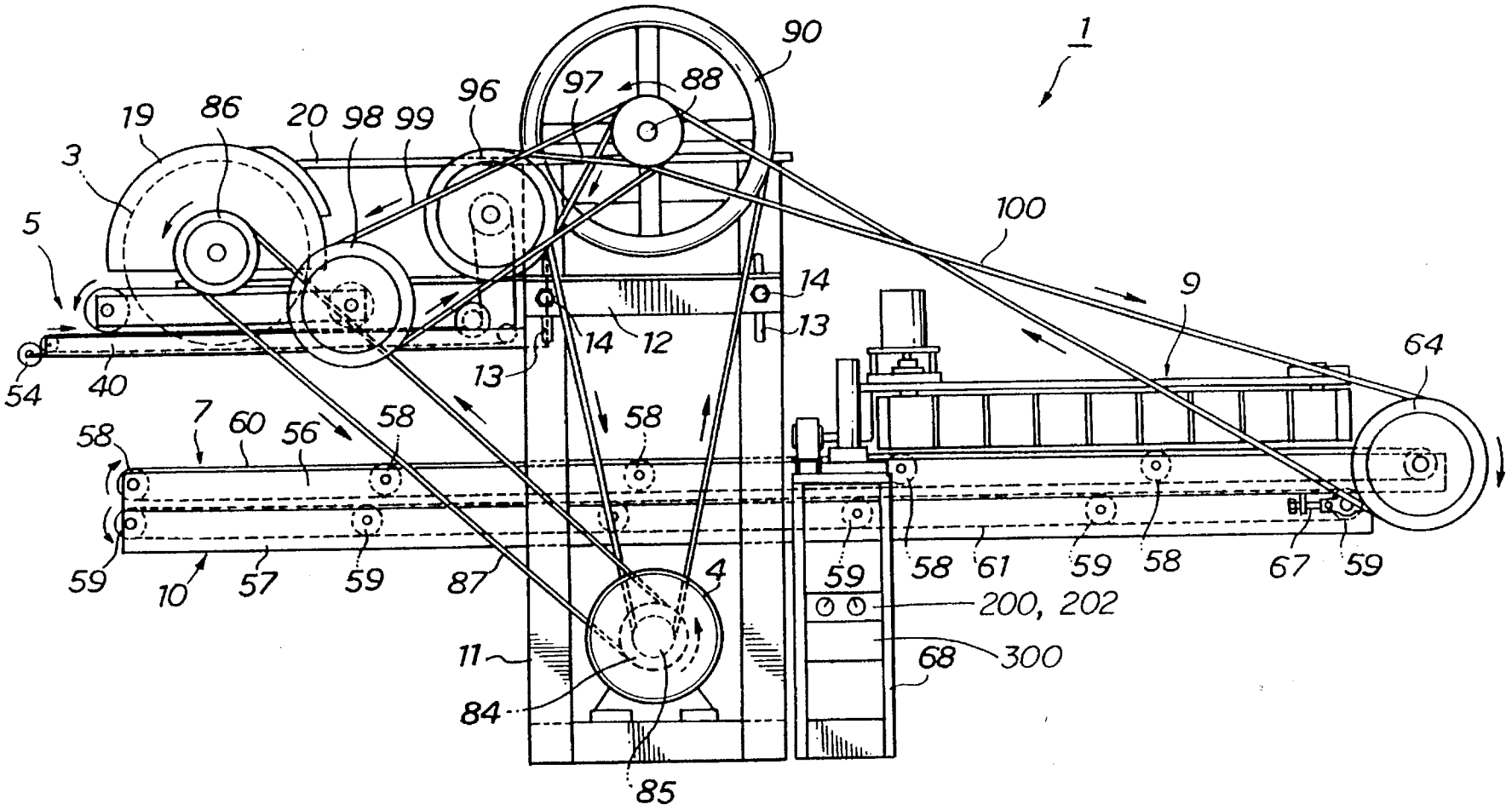
FIG. 4 is another side view of the same cutter apparatus, as viewed in the direction indicated by the arrow C of FIG. 1.

Each cutter 3 is covered by a cover 19, and the cutter 3 is exposed only underneath the cover 19, as shown in FIGS. 3 and 4.

Incidentally, the cover 19 itself is also supported in a manner such that its position can be adjusted along the rotary shaft 2 together with the cutter 3. In particular, as shown in FIG. 1, slits 21 are each formed in support members 20, which support the respective covers 19, and a slit 22 is also formed in a horizontal steel bar of the base 11. The support members 20 are fixed at desired positions by bolts 23, which penetrate the slits 21 and 22. After loosening the bolts 23, it is possible to adjust the positions of the support members 20 and the covers 19 supported by them arbitrarily along the slit 22.

Next, the structure of the cloth feeder 5 will be described with reference to FIGS. 5 through 10.

As shown in FIG. 5, each cloth feeder 5 is composed of an upper timing belt assembly 24 and a lower timing belt assembly 25, and the upper timing belt assembly 24 is supported in a manner such that it can be freely shifted vertically.

Figure 8:
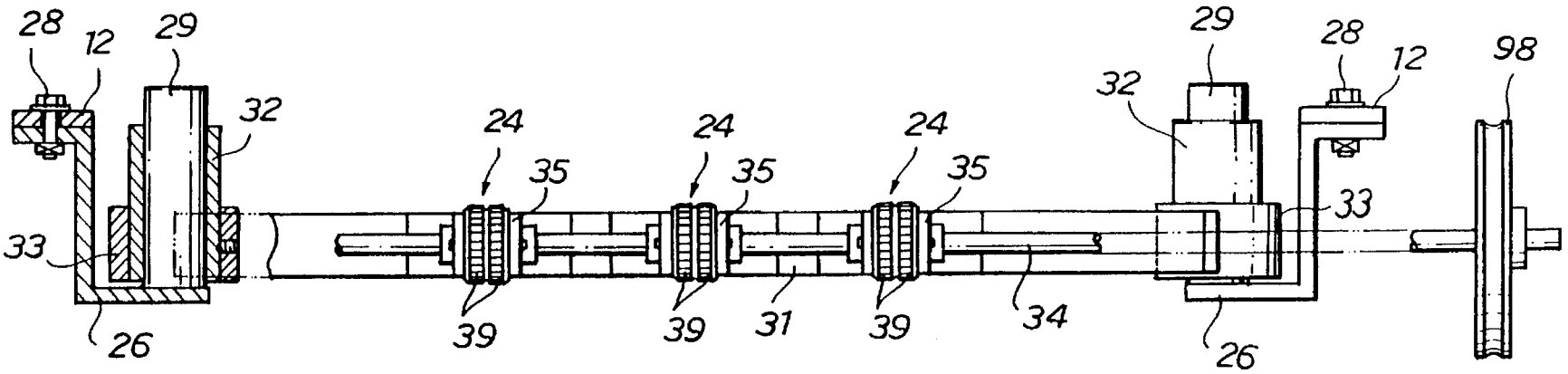
FIG. 8 is a front view of an upper timing belt assembly of the cloth feed means with parts partially broken away.
Figure 9:
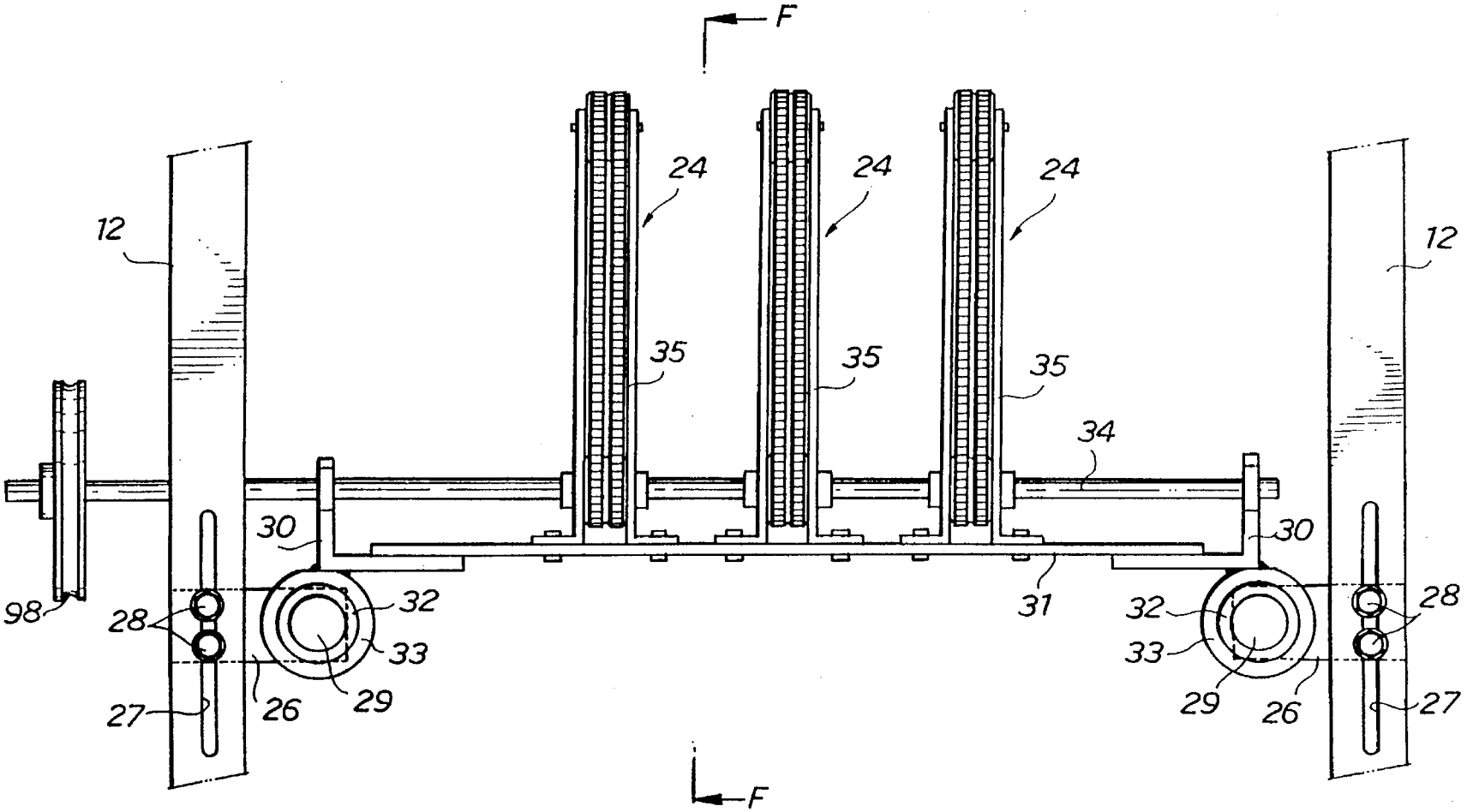
FIG. 9 is a top plan view of the same upper timing belt assembly.
Figure 10:
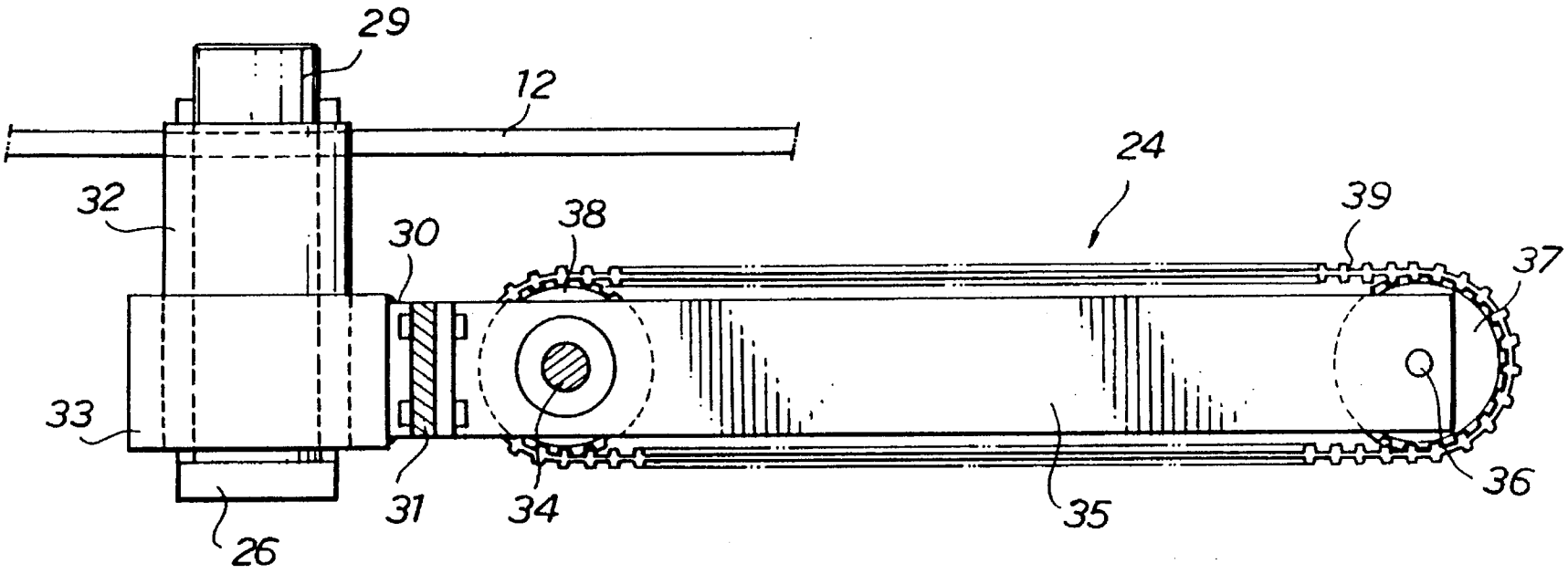
FIG. 10 is a sectional view taken along the lines F—F of FIG. 9.

With reference to FIG. 8 through FIG. 10, the structure of the upper timing belt assembly 24 and its support mechanism will be explained. To each one of the frames 12 is attached a support stay 26, which is shaped like a letter "Z" when seen from the front side, in a manner such that the support stays 26 can be shifted relative to the frames 12. In particular, as shown in FIG. 9, each frame 12 is formed with a slit 27, which extends forward and backward with respect to the cutter apparatus 1, and the support stays 26 are fastened to the respective frames 12 by the bolts 28 penetrating through the support stays 26 and the slits 27. It is possible to shift the support stays 26 forward and backward after loosening the bolts 28.

Vertical shafts 29 are welded to the horizontal parts of the respective support stays 26, and on these shafts 29 are supported a pair of bearing members 30, which are shaped like a letter "L" when seen from the above, and a support frame 31, whose ends are welded to the respective bearing members 30, via linear bearing sets 32 and cylindrical sleeve blocks 33 in a manner such that the bearing members 30 together with the support frame 31 are freely shifted vertically along the shafts 29.

A horizontal rotary shaft 34 is supported by the pair of the bearing members 30 in a manner such that the rotary shaft 34 is freely rotative, and the upper timing belt assemblies 24 are respectively attached to the support frame 31 at the locations where the cutters 3 come.

Each upper timing belt assembly 24 has a horizontal holder case 35, whose end portion is connected to the support frame 31, a timing pulley 37, which is freely rotatively supported at the free (front) end of the holder case 35 by means of a rotary shaft 36, a timing pulley 38, which is locked on the rotary shaft 34, which penetrates the rear end portion of the holder case 35, and the two timing belts 39, which are passed and wound round the timing pulleys 37, 38. Incidentally, the two timing belts 39 are double timing belts of which the both sides are formed with corrugation, and as shown in FIG. 7, the cutter 3 comes between the two timing belts 39.

Next, the structure of the lower timing belt assembly 25 will be described with reference to FIG. 5 and FIG. 6.

As illustrated in FIG. 3 and FIG. 4, there are provided three L letter-shaped stays 40 in front of the base 11 (rightward as seen in FIG. 3), corresponding to the three cutters 3, and two timing pulleys 41, 42 are supported by the horizontal portion of each stay 40 in a manner such that the pulleys 41, 42 are freely rotative by means of respective shafts 43, 44, as shown in detail in FIG. 5.

Also, a horizontal rotary shaft 45 is journaled freely rotative on the base 11 by means of a pair of bearing sets 46, one on the left and the other on the right, as shown in FIG. 1, and on this shaft 45 are locked three timing pulleys 47 (FIG. 5), and, as shown in FIG. 5 and FIG. 6, a pair of timing belts 48 each are passed and wound round the timing pulley 47 and the timing pulleys 41, 42, with a space provided between the timing belts 48 for the corresponding cutter 3 to be provided. A flanged tensioner 49 is provided for each pair of the timing belts 48 so as to impart an appropriate tension to them.

Incidentally, as shown in FIG. 5, the flanged tensioner 49 is supported by a vertical stay 50 in a manner such that the altitudinal position of the flanged tensioner 49 is adjustable. In particular, a vertically elongated slit 51 is formed in the stay 50, and the flanged tensioner 49 is fastened to the stay 50 by means of a bolt, not shown, which penetrates through the tensioner 49 and the slit 51. Therefore, by loosening the bolt it is possible to adjust the altitude of the flanged tensioner 49 whereby the tension of the timing belts 48 is adjusted.

Also, as shown in FIG. 5, at the free end of each stay 40 is provided a support arm 53, and a roller 54 for cloth separation is installed on the support arm 53 in a manner such that the roller 54 is freely rotative by means of a shaft 55.

Incidentally, each cloth separator 6, as shown in FIG. 5 is connected to the stay 50 at a location in the rear of the corresponding cutter 3, and the separator 6 has a tapered configuration when seen from above, as shown in FIG. 6, owing to the taper faces 6*a*, which converge together forwards (rightward as seen in FIG. 6).

Next, with reference to FIGS. 1 through 4, the structure of the belt conveyors 7, 10 will be described.

A pair of horizontal, parallel, even frames 56 and a pair of horizontal, parallel, even frames 57, which extend forward and backward with respect to the cutter apparatus 1, are supported by the base 11 in a manner such that the frames 56 are provided on the right of the frames 57, as seen in FIG. 2, and that the frames 56 are a litter higher than the frames 57. On the frames 56 are pivoted a plurality of rollers 58, which extend orthogonally to the frames 56, and are arranged in a row at appropriate intervals in the direction of forward and backward with respect to the cutter apparatus 1 (ref. FIG. 4). Similarly, rollers 59 are pivoted on the frames 57 freely rotative.

The belt conveyor 7, which constitutes the first cloth transportation means, comprises an endless belt 60 which is passed and wound round the rollers 58, and similarly the belt conveyor 10, which constitutes the second cloth transportation means, comprises an endless belt 61 which is passed and wound round the rollers 59. As seen in FIG. 1, the belt conveyors 7 and 10 are situated close to each other. From one end of the rearmost roller 58 of the belt conveyor 7 extends a rotary shaft 62, at the end of which is locked a pulley 64. Similarly, one end of the rearmost roller 59 of the belt conveyor 10 extends a rotary shaft 63, at the end of which is locked a pulley 65.

Incidentally, the rearmost rollers 58, 59 of the respective belt conveyors 7, 10 are shiftable forward and backward relative to the frames 56, 57, and by shifting the rollers 58, 59 backward or forward by means of respective adjuster mechanisms 66, 67, it is possible to adjust the tensions of the belts 60, 61 at will.

Figure 11:
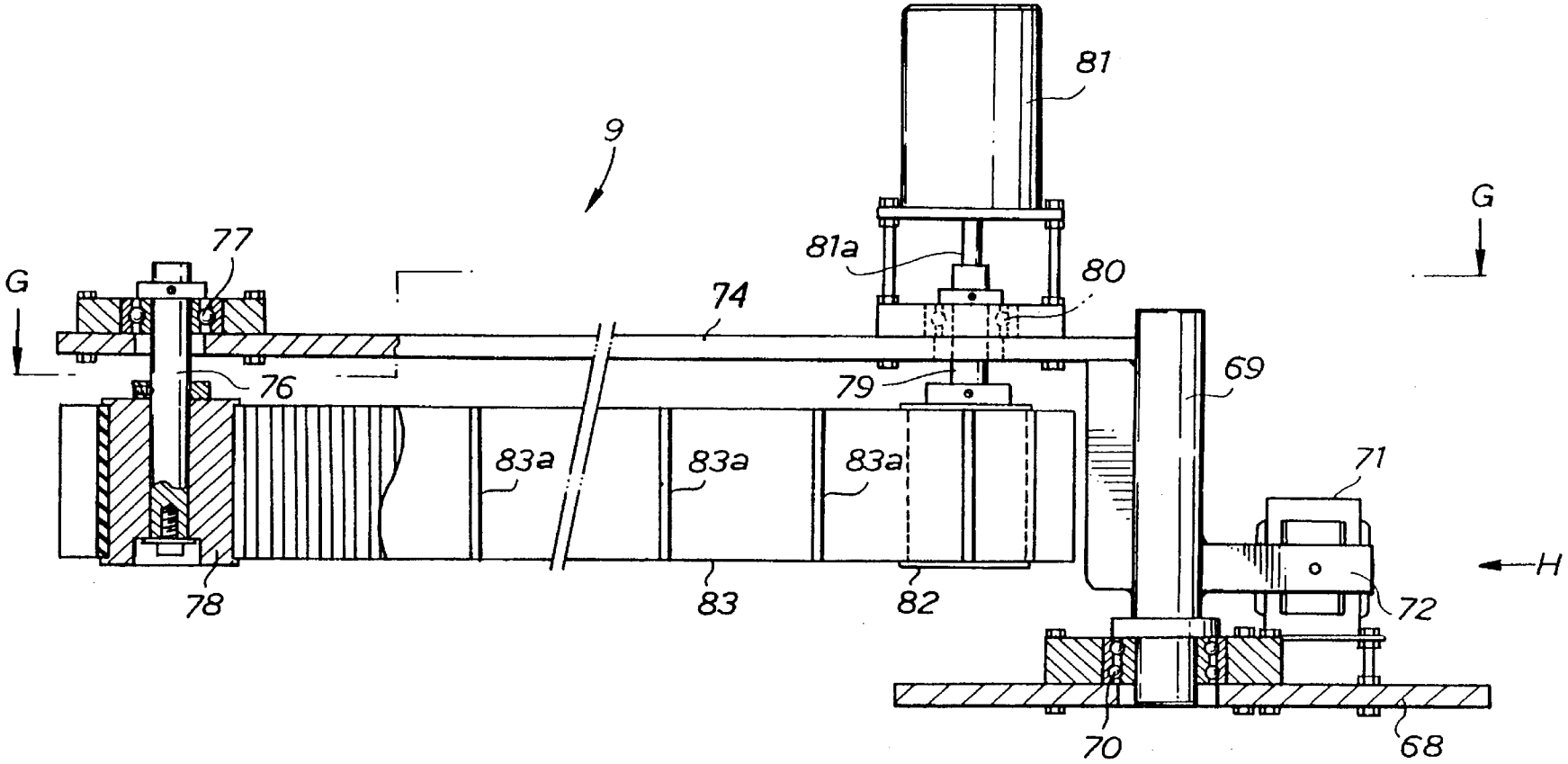
FIG. 11 is a side view of the sort means with parts partially broken away.

Next, with reference to FIGS. 11 through 13, the structure of the sorter 9 will be explained in detail.

As shown in FIG. 1, FIG. 3 and FIG. 4, a support base 68 is provided on one side of the belt conveyor 7 at a location halfway between the end rollers 58. A vertical shaft 69 is erected from the support base 68 in a manner such that the shaft 69 is freely rotative by means of the bearing set 70, and a solenoid 71 as the actuator is provided on the support base 69, as shown in detail in FIG. 11 through FIG. 13.

A horizontal arm 72 is connected to the vertical shaft 69, and this arm 72 is interconnected to the output shaft 71*a* of the solenoid 71 by way of a wire 73.

A plate-shaped horizontal support arm 74 is attached to the vertical shaft 69 on the opposite side of the arm 72 with a reinforce rib supporting the arm 74. A rotary shaft 76 is vertically journaled in the free end of the support arm 74 by means of a bearing set 77 in a manner such that the shaft 76 is freely rotative. A timing pulley 78 is locked on the rotative shaft 76. A rotative shaft 79 is vertically supported by the support arm 74 at a location near the vertical shaft 69 in a manner such that the shaft 79 is freely rotative by means of a bearing set 80, and the upper end of the rotary shaft 79 is connected to the output shaft 81*a* of a motor 81 installed on the support arm 74, and the lower end of the rotary shaft 79 is connected to a timing pulley 82.

Round the timing pulleys 78, 82 are passed and wound a timing belt 83 whose outer face is formed with a plurality of fins 83*a* at intervals.

As shown in FIG. 1, the support arm 74 of the sorter 9 is always pulled clockwise by means of a return spring 102, which is connected and expanded between the support arm 74 and the support base 68, and, therefore, when the solenoid 71 is not actuated, the sorter 9 assumes a position indicated in one-dot chain line in FIG. 1 (off-belt position).

Incidentally, as shown in FIG. 2, an operation switch 103 for manually operating the Sorter 9 is provided in the front part (cloth feed side) of the cutter apparatus 1.

Next, the drive system of the cutter apparatus 1 will be explained with reference FIGS. 1 through 4.

At the end of the output shaft of the drive motor 4 are locked a large-diameter pulley 84 and a small-diameter pulley 85. A belt 87 is passed and wound round the large-diameter pulley 84 and a pulley 86 locked at one end of the rotary shaft 2.

Incidentally, on top of the base 11 is supported a horizontal rotary shaft 88 with its both ends journaled by bearing sets 89 so that the rotary shaft 88 is freely rotative. A large-diameter pulley 90 and three small diameter pulleys 91, 92, 93 are locked in a row at one end of the rotary shaft 88 in this order with the pulley 93 at the outermost. A small-diameter pulley 94 is locked at the other end of the rotary shaft 88.

A belt 95 is passed and wound round the large-diameter pulley 90 and the small-diameter pulley 85, and a belt 97 is passed and wound round the pulley 91 and a pulley 96 locked at one end of the rotary shaft 45 in a manner such that the belt 97 crosses each other halfway between the pulley 91 and the pulley 96. A belt 99 is passed and wound round the pulley 92 and a pulley 98 locked at one end of the rotary shaft 34. Further, a belt 100 is passed and wound round the pulley 93 and the pulley 64 in a manner such that the belt 100 crosses each other halfway between the pulley 93 and the pulley 64. A belt 101 is passed and wound round the pulley 94 and the pulley 65.

Next, the operation of the cutter apparatus 1 will be described.

When the drive motor 4 is started and the output shaft is turned counterclockwise, as seen in FIG. 4, this rotation torque is transmitted to the rotary shaft 2 via the pulley 84, the belt 87, and the pulley 86, and to the rotary shaft 88 via the pulley 85, the belt 95, and the pulley 90. As the result, the rotary shaft 2 and the rotary shaft 88 are caused to turn counterclockwise, as seen in FIG. 4.

When the rotary shaft 2 starts turning counterclockwise as described above, the three cutters 3 locked on this shaft 2 are caused to turn simultaneously in the same direction.

Also, as the rotary shaft 88 starts turning counterclockwise as described above, the rotational torque is further transmitted to the rotary shaft 45 via the pulley 91, the crossed belt 97, and the pulley 96, and also to the rotary shaft 34 via the pulley 92, the belt 99, and the pulley 98, whereupon the rotary shafts 45, 34 are caused to turn in the opposite directions (the rotary shaft 34 turning in the same direction as the rotary shaft 88).

When the rotary shafts 34, 45 start turning in the opposite directions, as described above, the upper and lower timing belt assemblies 24, 25, which are respectively connected to these rotary shafts 34, 45, are driven in the opposite directions. In other words, the rotation of the rotary shaft 34 causes the three timing pulleys 38 of the timing belt assemblies 24 to turn clockwise, as seen in FIG. 5, and thus the timing belts 39 run clockwise also. On the other hand, the counterclockwise rotation of the rotary shaft 45, as viewed in FIG. 5, causes the three timing pulleys 47 of the timing belt assemblies 25 to turn counterclockwise, and thus the timing belts 48 run counterclockwise, as indicated by arrows in FIG. 5. So, the two belts 39 and 48 run in the same direction when they meet each other.

The rotational torque of the rotary shaft 88 is also transmitted to the rearmost roller 58 of the belt conveyor 7 via the pulley 93, the crossed belt 100, and the pulley 64, and at the same time, the torque is transmitted to the rearmost roller 59 of the belt conveyor 10 via the pulley 94, the belt 101, and the pulley 65. As the result, the two rollers 58, 59 turn in the opposite directions. It is so arranged that the belt 60 of the belt conveyor 7 runs such that its upper half moves backward (away from the cloth feed side or leftward, as viewed in FIG. 1) as indicated by an arrow, and the belt 61 of the belt conveyor 10 runs such that its upper half moves forward (toward the cloth feed side or rightward, as viewed in FIG. 1) as also indicated by an arrow.

Now, at this moment, cloth W such as an old dress from which buttons have already been removed by means of an edged tool or some other means, is sent in the direction of the fat arrow of FIG. 5. If the cloth W has lining cloth or a tubular cloth such as a sleeve, such part of the cloth W is separated into two parts by means of the cloth separator roller 54 and the separated upper half W proceeds toward the three cutters 3, while the lower half drops. The cloth W is then sandwiched between the timing belts 39, 48 of the upper and lower timing belt assemblies 24, 25 and sent toward the three cutters 3 (backward). Incidentally, as described above, in the present embodiment, the upper timing belt assembly 24 is supported in a manner such that it can be shifted vertically, so that by adjusting the distance of the upper timing belt assembly 24 from the lower timing belt assembly 25 in accordance with the thickness of the cloth W, it is possible to firmly sandwich the cloth W of various thicknesses between the two timing belt assemblies 24, 25, so that the cloth W is cut properly without being hitched by the cutters 3.

The cloth W is then simultaneously cut into four pieces between the two timing belts 39, 48 of the timing belt assemblies 24, 25 by the three cutters 3 which are turning clockwise, as viewed in FIG. 5. The cut pieces are separated apart by means of the cloth separator 6.

The cloth pieces W which has been clearly cut by the cutters 3 and separated by the cloth separator 6 are dropped on the belt 60 of the belt conveyor 7, which runs below the cutters 3, and are carried backward (leftward, as viewed in FIG. 1) by the belt 60.

In this embodiment, the length of the cloth W as taken in the direction of feed is always measured by a measurement means. As shown in FIG. 2, a pair of optical sensors 8*a*, 8*b* are provided at the cloth feed side of the cutter apparatus 1 in a manner such that the optical sensor 8*a* is located exactly above the optical sensor 8*b*, which both are situated at a location midway between the sides of the belt conveyor 7 and near the front end of the belt conveyor 7. As long as the light emitted from the lower optical sensor 8*b* is sensed by the upper optical sensor 8*a*, the time is not counted; when the light from the optical sensor 8*b* is intercepted by the cloth W, and the optical sensor 8*a* fails to sense the light, counting of the time is started and continued until the optical sensor 8*a* senses the light from the optical sensor 8*b* again.

In this embodiment, the length of the cloth W is measured by a timer ①, not shown, in terms of the number t it counts during the lapse of time for which the optical sensor 8*a* does not sense the light from the optical sensor 8*b*. In the automatic mode, whenever the number t exceeds a predetermined number t1 (t>t1), a control means, not shown, supplies a drive signal to the sorter 9, whereupon a timer ② starts counting and the sorter 9 is driven to the sorting position and kept there until the timer ② counts up a predetermined number t2 (corresponding to a time length sufficient for the cloth W of excessive lengths to be entirely sorted out).

On the other hand, when an operator presses the operation switch 103, the operation mode is switched from the automatic mode to the manual mode, and the timer ② starts counting and the sorter 9 is driven to the sorting place and kept there until the time ② counts up a predetermined number t3 (corresponding to a time length sufficient for the sorter 9 to sort out the cloth W which requires further treatment).

Figure 14:
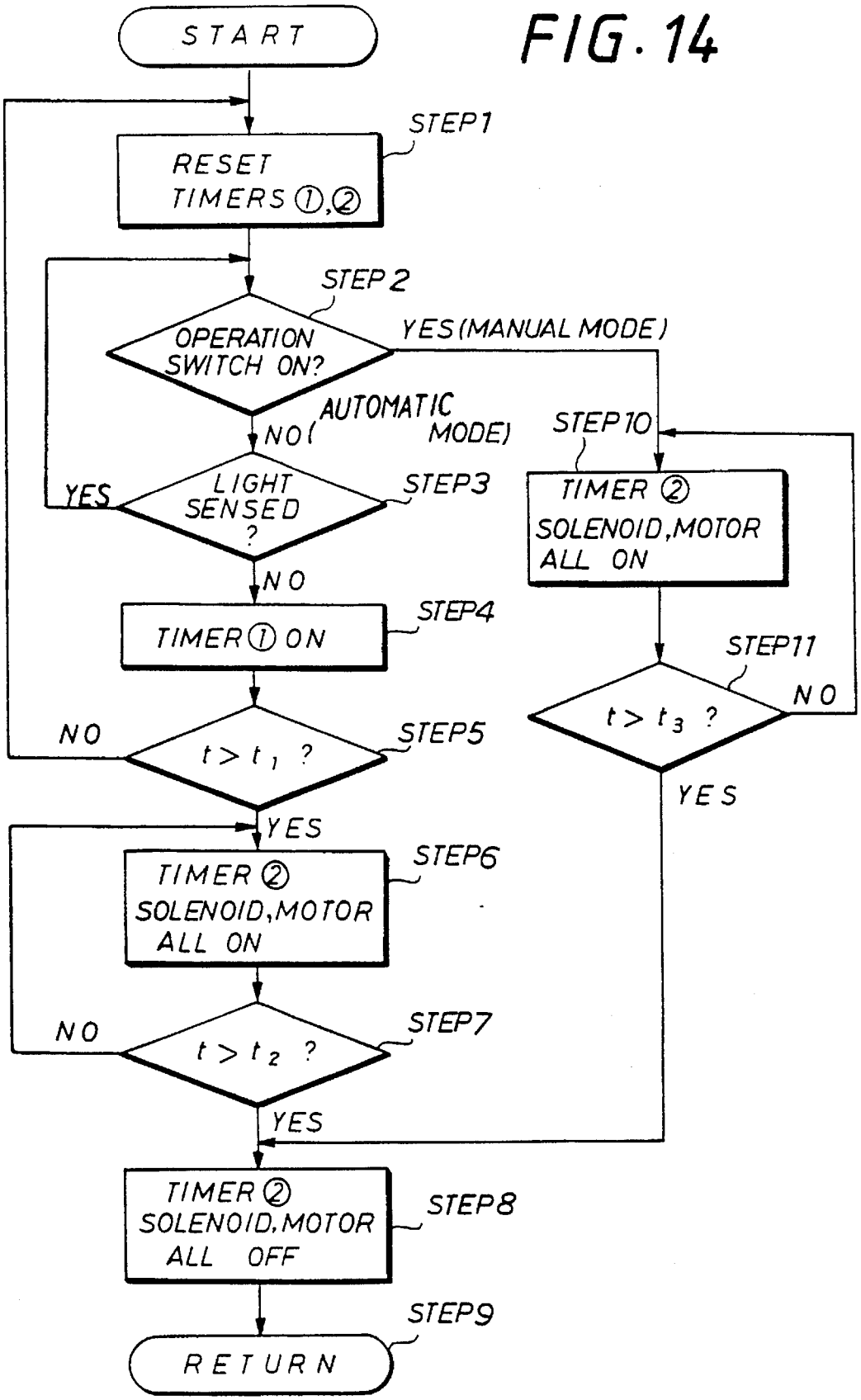
FIG. 14 is a flowchart with which it is useful to explain the controlled procedure of cloth sorting.
Figure 15:
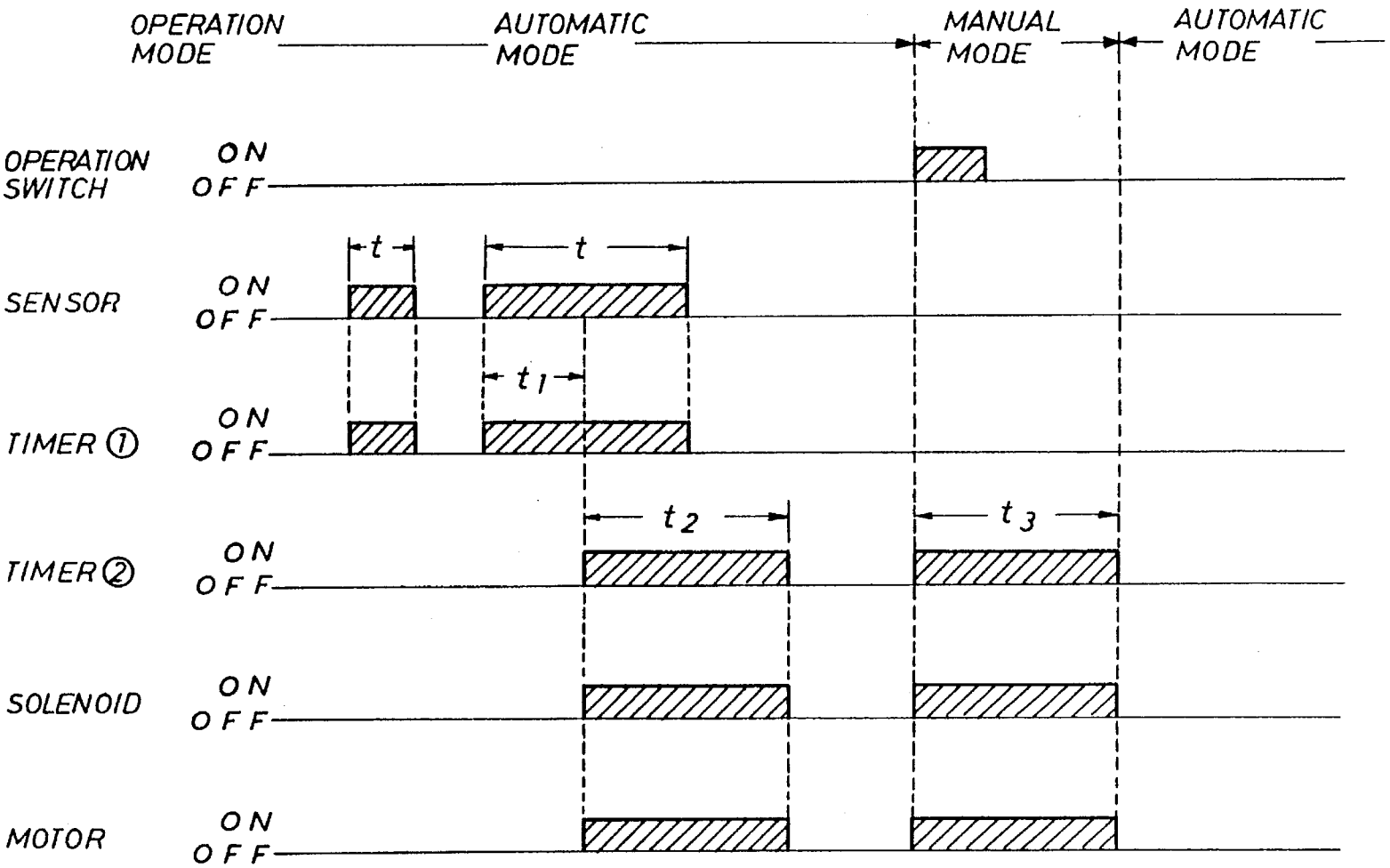
FIG. 15 is a timing chart to show the chronological operation pattern of timers, solenoid and motor.
Figure 18:
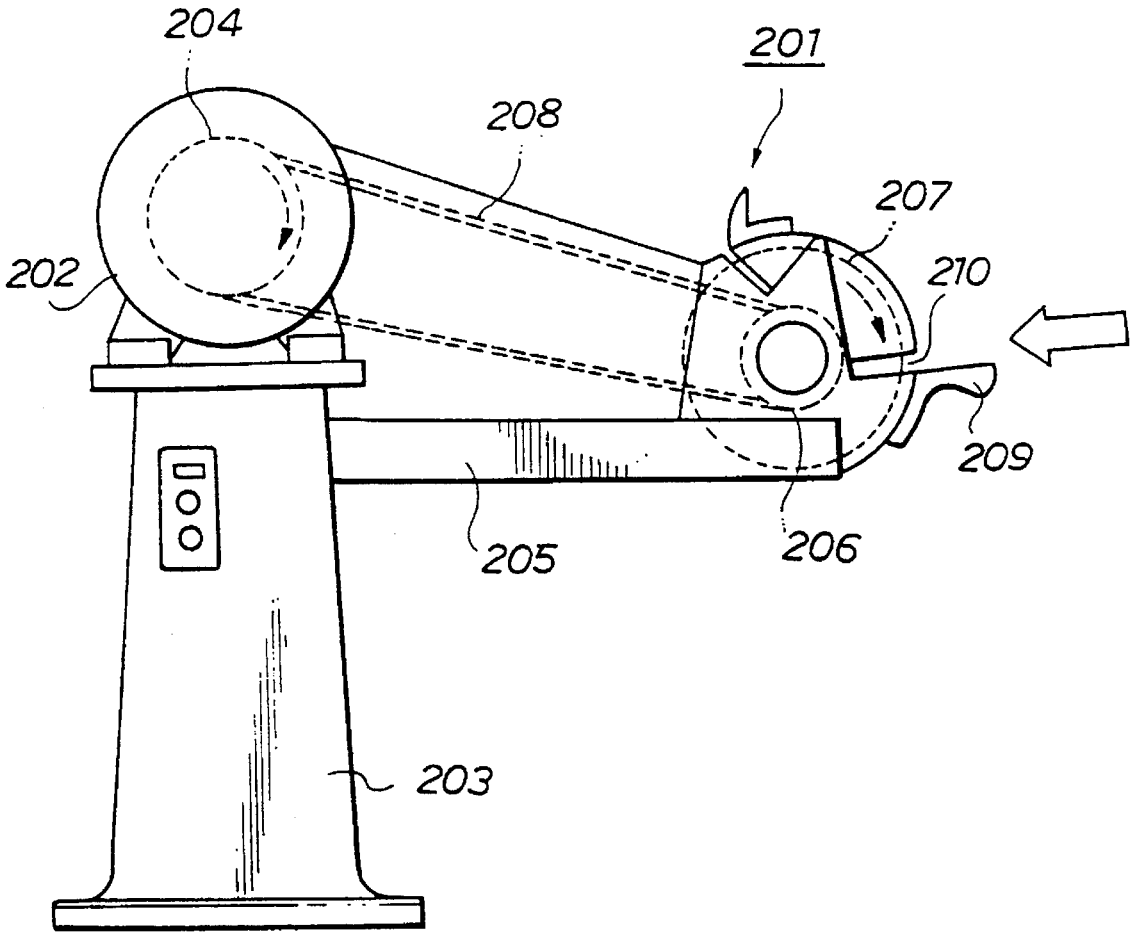
FIG. 18 (PRIOR ART)
FIG. 18 depicts a cutter apparatus of the prior art.

Next, the procedure of sorting the cloth W will be explained with reference to a flowchart shown in FIG. 14 and a timing chart shown in FIG. 15.

First, when the cutters apparatus 1 is switched on, the timers ①, ② are reset (STEP 1 of FIG. 14); then it is detected whether or not the operation switch 103 is turned on (STEP 2). If the operation switch 103 is not turned on, the operation mode is currently in the automatic mode, and it is then detected whether or not the optical sensor 8*a* is sensing the light from the optical sensor 8*b* (STEP 4). When the cloth W is passing between the optical sensors 8*a*, 8*b*, the answer to this question is NO, and then the program proceeds to STEP 4; on the other hand if the cloth W is not yet passing and thus the two sensors 8*a*, 8*b* are optically connected, the program returns to STEP 2.

When the cloth W is fed to the cutter apparatus 1 and the optical sensor 8*a* stops sensing the light, the program proceeds to STEP 4 and the timer ① starts counting, and when the optical sensor 8*a* senses the light again, it is detected whether or not the number t counted by the timer ① is greater than the predetermined number t1 (STEP 5).

If the length of the cloth W is relatively small, the number t is smaller than t1; then the program returns to STEP 1, and the sorter 9 is not driven from the off-belt position. Thus, the cloth W cut by the cutters 3 are transported backward (leftward, as viewed in FIG. 1) on the belt conveyor 7, and eventually collected for use as waste.

On the other hand, if the length of the cloth W is relatively large, the number t counted by the timer ① tends to be greater and if it exceed t1, the program goes to STEP 6, whereupon the timer ② starts counting and at the same time the solenoid 71 and the motor 81 are operated to drive the sorter 9 to the sorting position.

Figure 12:
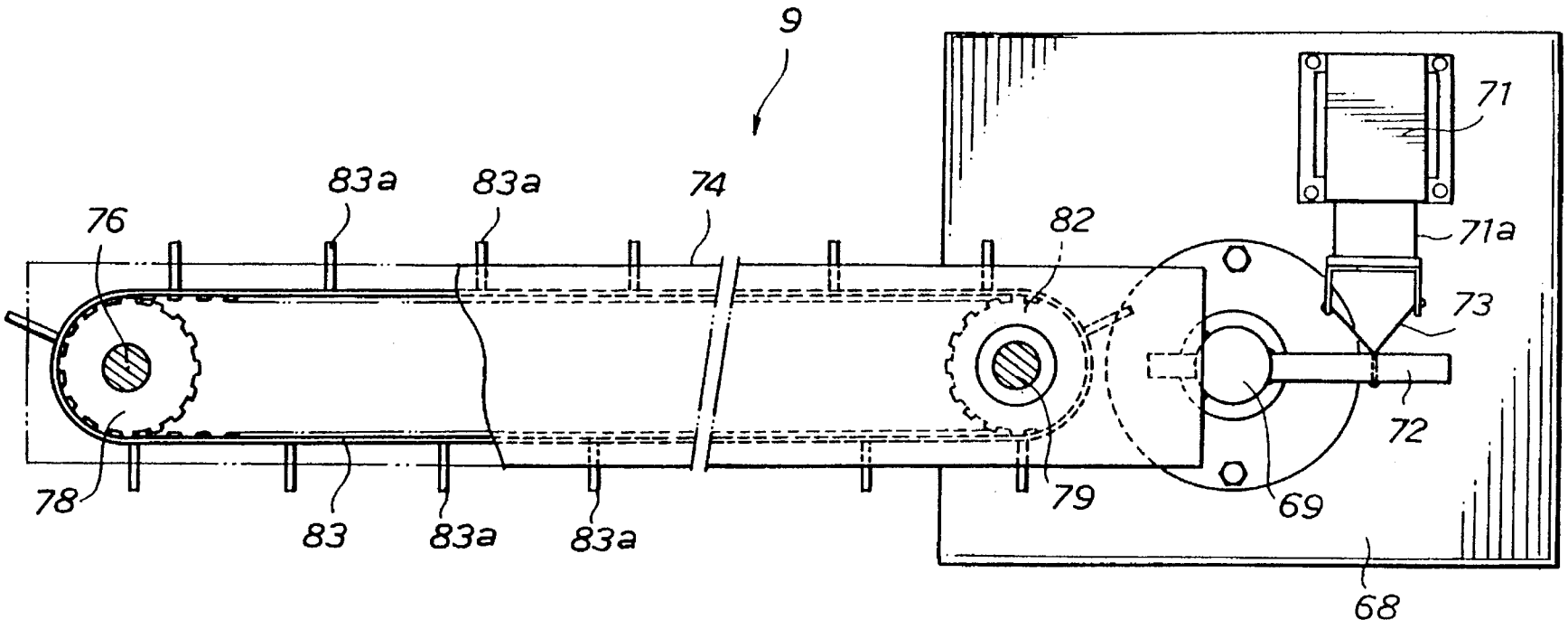
FIG. 12 is a sectional view taken along the lines G—G of FIG. 11
Figure 13:
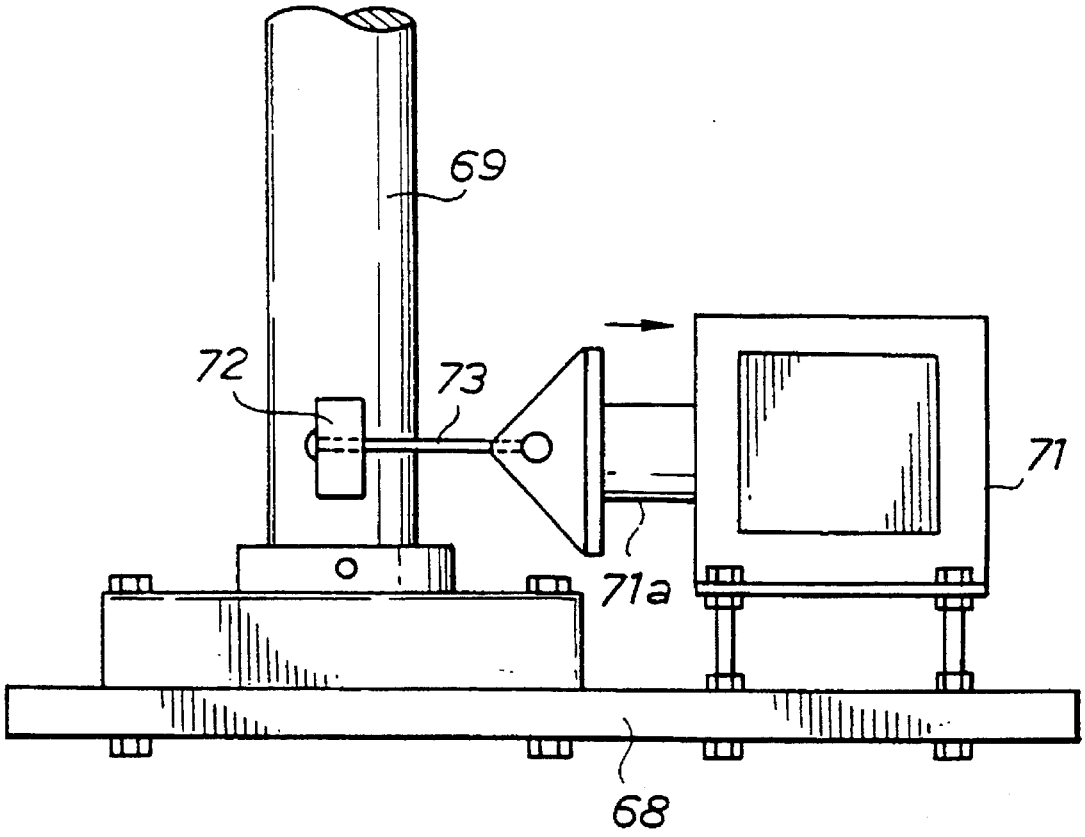
FIG. 13 is a view seen in the direction of the arrow H of FIG. 11.

Thus, the output shaft 71*a* of the solenoid 71 is withdrawn in the direction indicated by an arrow in FIG. 12 and FIG. 13, and by virtue of the wire 73 and the arm 72, the vertical shaft 69 is turned counterclockwise, as viewed in FIG. 12, by a predetermined angle, and as the result the sorter 9 is also swung by the same angle to assume the sorting position as it is assuming in FIG. 1. Simultaneously as this, the motor 81 is driven and its rotational torque is transmitted from the output shaft 81*a* to the rotary shaft 79 so that the timing pulley 82 locked on the rotary shaft 79 is turned and consequently the timing belt 83 starts running clockwise as indicated by arrows in FIG. 1.

This operation of the sorter 9, that is, the driving of the solenoid 71 and the motor 81 is maintained until the number t that is counted by the timer ② exceeds the number t2 (STEP 7). The excessively long cloth pieces W cut by the cutters 3 and transported backward on the belt conveyor 7 are removed from the belt conveyor 7 by means of the running timing belt 83 of the sorter 9. The sorted cloth pieces W are dropped on the other belt conveyor 10, and carried toward the cloth feed side (rightward, as viewed in FIG. 1), and cut again. Incidentally, the predetermined number t2 (corresponding to the time during which the sorter 9 is driven) is set to a sufficiently large value for one feed of the cloth W to be entirely sorted out.

As the predetermined number t2 is counted out by the timer ②, all the long cut pieces of cloth W are sorted out, as described above, and at the same time the timer ②, the solenoid 71, and the motor 81 are all turned off (STEP 8), whereupon the turning of the timing belt 83 of the sorter 9 is stopped and the support arm 74 is pulled back to the off-belt position by virtue of the return spring 102 (ref. FIG. 1). Then the program returns to the START, and the same program is repeated.

As described above, in the present embodiment, the cloth W fed to the three cutters 3 by means of the cloth feeder 5 are cut into four pieces at a time and the cut pieces are automatically sorted out according to their lengths. In other words, the lengths of the cloth W is measured by the measurement means, and those long cut pieces which require further cutting are moved from the belt conveyor 7 to the belt conveyor 10 by means of the sorter 9 and returned to the cloth feed side again. Therefore, it is possible for the operator to feed again the long cut cloth pieces W which have been automatically sorted out and returned to the cloth feed side where he/she is. Thus, there is no need for sorting out the long cut pieces by hand, and the operation efficiency is significantly improved.

When the cloth W has a shoulder pad or the like attached to it, such attachments ought to be removed; however, if the cloth W is relatively short, it will not be sorted out when the cutter apparatus 1 is in the automatic mode. Therefore, when feeding such cloth W, the operator presses the operation switch 103 to thereby switch the operation mode from automatic to manual (STEP 2). Then, the timer ② starts counting, and at the same time the solenoid 71 and the motor 81 are operated to drive the sorter 9 (STEP 10).

Thus, similarly as at STEP 6, the sorter 9 is kept operated until the number t counted by the timer ② exceeds the number t3 (STEP 11). The cloth pieces W which need be treated again because of the attachments such as shoulder pad are removed from the belt conveyor 7 by means of the running timing belt 83 of the sorter 9. The sorted cloth pieces W are dropped on the other belt conveyor 10, and carried toward the cloth feed side (rightward, as viewed in FIG. 1), and the attachments are removed from the cloth W. Incidentally, the predetermined number t3 (corresponding to the time during which the sorter 9 is driven) is set to a sufficiently large value for the cut cloth pieces W to be entirely sorted out.

When the cloth pieces W that require further treatment are sorted out, as described above, and the predetermined number t3 has been counted out, the timer ②, the solenoid 71, and the motor 81 are all turned off (STEP 8), whereupon the turning of the timing belt 83 of the sorter 9 is stopped and the support arm 74 is pulled back to the off-belt position by virtue of the return spring 102 (ref. FIG. 1). Then the program returns to the START, and the same program is repeated.

As described above, in the present embodiment, even when relatively short cloth W which has undesirous attachments which ought to be removed is fed to the cutters 3, the operator can sort out such cloth W by pressing the operation switch 103 to operate the sorter 9 for a time period corresponding to t3 to take it away after it is cut in pieces so as to remove the attachments from the cloth W, and cut the cloth W again. Thus, there is no need for manually sorting out the cut pieces with attachments one after another by hand, and the operation efficiency is significantly improved.

Although the cutter apparatus 1 of the above embodiment does not include a means to remove buttons and studs from the cloth W, it is possible to install at the feed side a button remover machine 110 such as the one shown in FIG. 16 and FIG. 17, which is adapted to be driven by a drive motor 4 same as the drive motor 4 of the cutter apparatus 1 of the first embodiment.

In particular, a vertical rotary shaft 112 is journaled in a bearing set 113 at the top of a housing 111 of the button remover machine 110 in a manner such that the rotary shaft 112 is freely rotative. A horizontal rotary shaft 104, whose one end not shown is supported by a frame corresponding to the frame 11 of the first embodiment, penetrates through the housing 111. At the free end of the rotary shaft 104 is locked a pulley 105, and an endless belt 107 is passed and wound round the pulley 105 and a pulley 106 locked at the end of the output shaft of the drive motor 4.

At the upper end of the rotary shaft 112 which extends outside the housing 111 is locked a disk-like horizontal cutter 115 by means of a boss member 114, which is fixed on the rotary shaft 112 by a vis. A bevel gear 116 is locked at the lower end of the rotary shaft 112 which is disposed inside the housing 111. This bevel gear 116 is meshed with a bevel gear 108, which is locked on the rotary shaft 104 at a location inside the housing 111. Incidentally, the cutter 115 is formed with a cutting edge along the periphery thereof.

Also, as shown in FIG. 16, a vertical stay 117 is erected on top of the housing 111, and a cover 119 to cover the cutter 115 is provided on top of the stay 117. This cover 119, as shown in FIG. 17, is circular, when viewed from above, with one arch cut off, and is concentric with the cutter 115, which is set inside the cover 119 and has a diameter such that the cutter 115 is inscribed by the top-plan-view profile of the cover 119 at the latter's cut-off straight line edge **119*b*. As shown in FIG. 16 also, when viewed from a side, the cover 119 is formed with a roof 119 a part of which 119*a* is sloped to descend toward the straight line edge 119*b*. Thus, the distance between the edge of the sloped roof 119*a* and the cutter edge is appropriately small. A guide recess 119*c* is formed at the midpoint of the straight line edge 119*b* of the sloped roof 119*a* where the cutter 115 is inscribed. The cover 119 is opened in a form of a slit along the straight line edge 119*b* with the cutter edge peeping in it. Also, the edge of the floor of the cover 119 at the slit is substantially receded from the edge of the sloped roof 119*a***.

When the drive motor 4 is driven, the rotational torque is transmitted to the rotary shaft 104 via the pulley 106, the belt 107, and the pulley 105, and the rotational torque of the rotary shaft 104 is transmitted to the rotary shaft 112 after torque's rotation axis is turned by 90 degrees by means of the bevel gears 108, 116, whereupon the rotary shaft 112 and the cutter 115 are caused to turn at a predetermined high rate.

While the button remover machine 110 is operating in a manner as described above, cloth W is held horizontally by both hands with a buttoned face looking downward, and the cloth W is forwarded in the direction indicated by the fat arrow of FIG. 17 (rightward, as viewed in the same figure) in a manner such that the front edge of the cloth W goes over the sloped roof 119*a* but the button 120 goes underneath the cutter 115 in the slit. In other words, the button is hooked in the guide recess 119*c* and the thread binding the button 120 to the cloth W is pressed to the running edge of the cutter 115. Thus, the thread is broken and the button 120 is removed from the cloth W and drops. When all the buttons are removed, the cloth W is fed to the cutters of the cutter apparatus again.

While the invention has been described in its preferred embodiments, it is to be understood that modifications will occur to those skilled in that art without departing from the spirit of the invention. The scope of the invention is, therefore, to be determined solely by the appended claims.

What is claimed is:

1. A cutter apparatus for cutting cloth, comprising:

(a) a plurality of disk-shaped cutters locked on a common horizontal shaft at selected intervals;

(b) a drive motor to turn the cutters;

(c) means to feed a length of cloth to the cutters by holding and advancing the cloth to cut the same into cloth pieces;

(d) means to separate the cut cloth pieces;

(e) first transport means to transport tile separated cloth pieces and to discharge them from the cutter apparatus;

(f) means to measure a length of the cloth being supplied to the cutters, the measured length being in the direction in which the cloth is cut into cloth pieces;

(g) means to sort out those cloth pieces which have measured lengths greater than a predetermined length;

(h) second transport means to transport the sorted out cut pieces back to a feed side of the cutter apparatus; and (i) control means to supply a drive signal to the sorting means when a measured length of cloth is greater than said predetermined length to thereby cause the sorting means to sort out cut pieces of such cloth and also to supply a stop signal to the sorting means when a predetermined time has lapsed from a start of sorting to thereby cause the sorting means to stop sorting.

2. The cutter apparatus as recited in claim 1, wherein:

said cloth feed means comprises several parallel pairs of an upper timing belt assembly and a lower timing belt assembly, each upper timing belt assembly being disposed over a corresponding lower timing belt assembly and the distance between the upper and lower timing belt assemblies being adjustable.

3. The cutter apparatus as recited in claim 2, wherein:

said upper and lower timing belt assemblies each comprise two endless track timing belts which run parallel to each other with a space formed between them for a cutter to be disposed therein, a plurality of timing pulleys over which said timing belts are passed, and a drive means to drive at least one of said timing pulleys.

4. The cutter apparatus as recited in claim 1, wherein:

the measurement means comprises a first optical means to emit a light, a second optical means to detect the emitted light, and a timer to start and stop counting in response to whether said light is detected by said second optical means, and wherein the measurement means measures time in terms of a number counted by said timer.

5. The cutter apparatus as recited in claim 1, wherein:

said sorting means comprises a swing arm, which assumes a sorting position over the first transport means, and an actuator to drive the swing arm, and wherein the swing arm is provided with an endless track timing belt operated such that any cloth contacted by the timing belt is moved toward a distal end of the swing arm, and an actuator adapted to drive the swing arm.

6. The cutter apparatus as recited in claim 5, wherein:

said sorting means is manually started in the sorting position and moves from the sorting position when a predetermined time has lapsed.

7. The cutter apparatus as recited in claim 3, further comprising:

button remover means, which includes a horizontal rotary cutter enclosed in a disk-like hollow cover body, where only a limited portion of an edge of the cutter is exposed from the cover body so that in an exposed position of the cutter edge, a first distance between the cutter edge and a roof of the cover body and a second distance between the cutter edge and a floor of the cover body, a button enters the cover body horizontally underneath the cutter edge at a location just above the exposed position of the cutter edge, and wherein the roof of the cover body being provided a guide recess to guide a button into the cover body.

* * * * *